US005876044A

United States Patent [19]

Yin

[11] Patent Number: 5,876,044

[45] Date of Patent: Mar. 2, 1999

[54] FRAME STRUCTURE FOR AN IN LINE ROLLER SKATE

[76] Inventor: Chao-Hung Yin, 2F, No. 22, Lane 70, Tsto Ti Wei, Shen-Keng Hsiang, Taipei Hsien, Taiwan

[21] Appl. No.: 810,758

[22] Filed: Mar. 4, 1997

[51] Int. Cl.[6] ..... A63C 17/06

[52] U.S. Cl. ..... 280/11.22; 280/11.3

[58] Field of Search ..... 280/809, 811, 280/816, 841, 11.19, 11.2, 11.22, 7.13, 11.27, 11.26, 11.3

[56] References Cited

U.S. PATENT DOCUMENTS

| | | | |
|---|---|---|---|
| 55,901 | 6/1866 | Plimpton | 280/7.13 |
| 3,086,787 | 4/1963 | Wyche | 280/11.19 |
| 3,387,852 | 6/1968 | Sarro | 280/11.22 |
| 5,277,437 | 1/1994 | Moats | 280/11.23 |
| 5,732,957 | 3/1998 | Yu | 280/11.19 |
| 5,765,841 | 6/1998 | Johnson et al. | 280/11.22 |
| 5,772,220 | 6/1998 | Gaster | 280/7.1 |
| 5,799,955 | 9/1998 | Iverson | 280/11.22 |
| 5,803,466 | 9/1998 | Wrike | 280/7.13 |
| 5,810,369 | 9/1998 | Wilder et al. | 280/11.22 |

*Primary Examiner*—Brian L. Johnson
*Assistant Examiner*—Bridget Avery
*Attorney, Agent, or Firm*—Bacon & Thomas, PLLC

[57] ABSTRACT

A frame structure for an in line roller skate, including a sole plate for holding a boot at the top and a row of rollers at the bottom, and two side wings detachably fastened to two opposite lateral sides of the sole plate by screws for performing stunt skating.

2 Claims, 4 Drawing Sheets

FRAME STRUCTURE FOR AN IN LINE ROLLER SKATE

BACKGROUND OF THE INVENTION

The present invention relates to a frame structure for an in line roller skate, and more particularly to such a frame structure which includes two detachable side wings adapted for performing stunt skating.

Conventional roller skates are commonly comprised of a sole plate equipped with two pairs of wheels for skating. Nowadays, in line roller skates have become more and more popularly accepted for the advantage of being practical for performing stunt skating to jump over obstacles, to skate on stairs, a round rod or wall edge, etc. A regular in line roller skate is generally comprised of a sole plate, a boot mounted on the sole plate at the top, and a row of rollers mounted on the sole plate at the bottom. Because the contact area between the sole plate and the boot is narrow, it is difficult to perform stunt skating. Furthermore, because the boot is made from plastic, it tends to be damaged when rubbed against an object during stunt skating. If the boot is damaged or the sole plate wears, the roller skate becomes useless.

SUMMARY OF THE INVENTION

The present invention has been accomplished to provide a frame structure for an in line roller skate which eliminates the aforesaid problems. According to the present invention, the frame structure comprises a sole plate for holding a boot at the top and a row of rollers at the bottom, and two side wings detachably fastened to two opposite lateral sides of the sole plate by screws for performing stunt skating. Each side wing comprises a flat base and guide flanges adapted for moving on a rail, round rod, wall edge, etc., to perform stunt skating, and bumper flanges for protecting the boot. Because the side wings are detachably fastened to the sole plate, they are replaceable. If not required, the side wings can be detached from the sole plate.

DETAILED DESCRIPTION OF THE PREFERRED EMBODIMENT

Figure 1:
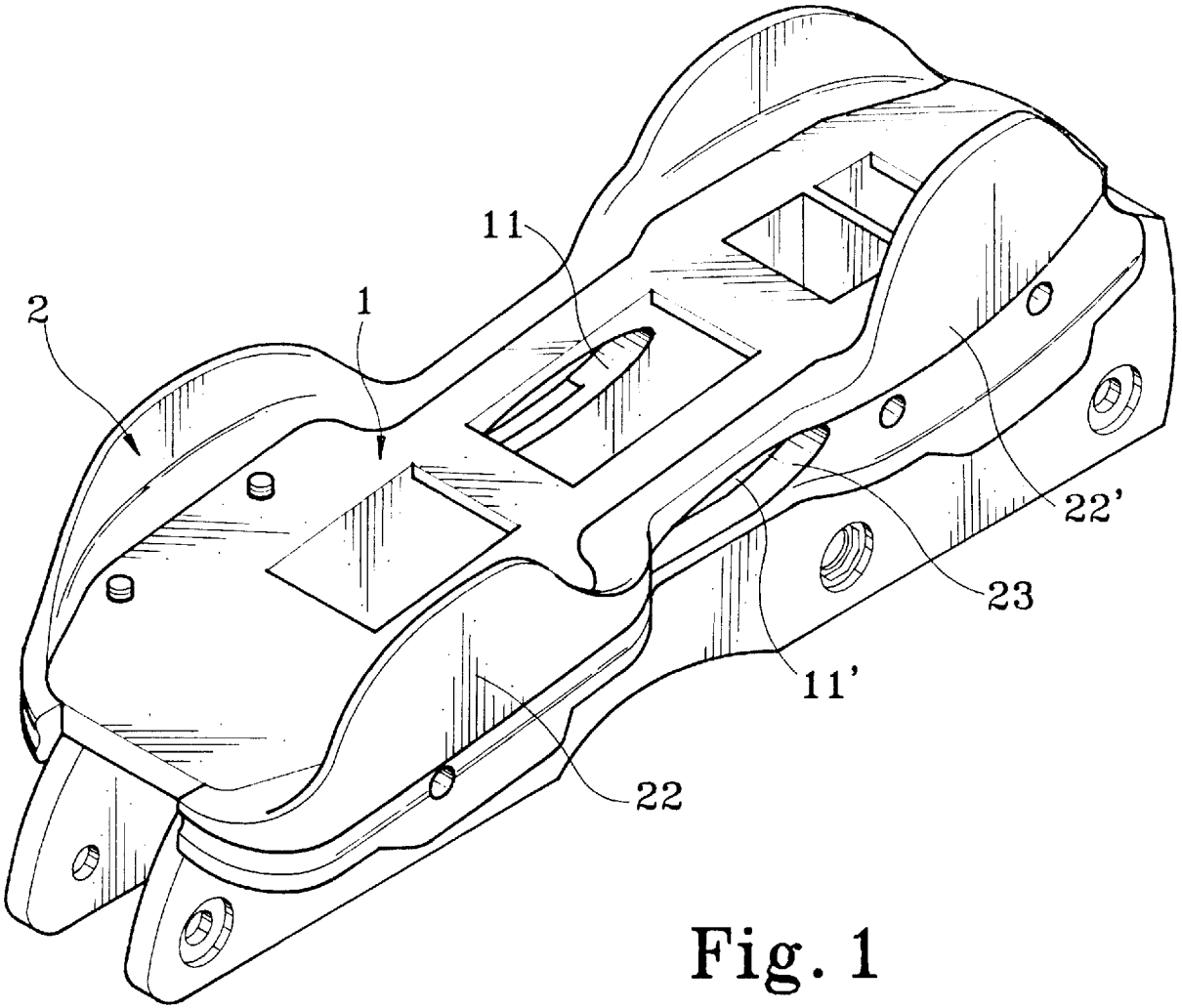
FIG. 1 is an elevational view of a frame structure for an in line roller skate according to the present invention.
Figure 2:
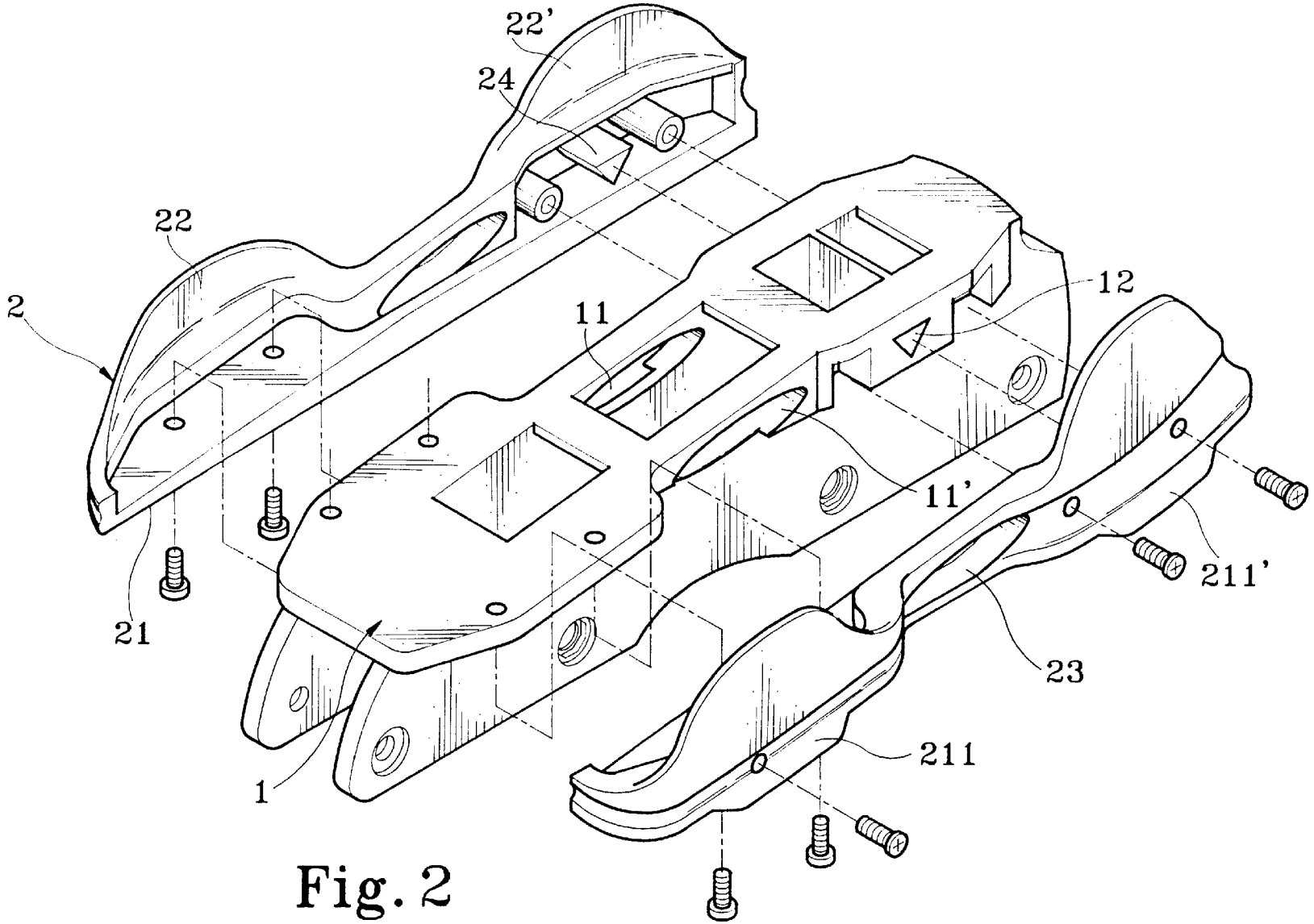
FIG. 2 is an exploded view of the frame structure shown in FIG. 1.

Referring to FIGS. 1 and 2, a frame structure of an in line roller skate in accordance with the present invention is generally comprised of a sole plate 1, and two side wings 2. The sole plate 1 is adapted for holding a boot 3 at the top and a row of rollers 4 at the bottom (see also FIG. 3).

The side wings 2 are symmetrical, comprising each a flat base 21, a front guide flange 211 and a rear guide flange 211' respectively and downwardly extending from the flat base 21 at an outer side, a front bumper flange 22 and a rear bumper flange 22' vertically raised from the flat base 21 to serve as fence means for protecting the boot 3, a horizontal strap slot 23 spaced between the front bumper flange 22 and the rear bumper flange 22' and adapted for mounting a binding strap 5, and a horizontal dowel pin 24 spaced above the flat base 21 near the rear end. The flat base 21 of each side wing 2 is fastened to the sole plate 1 at one side by screws. The sole plate 1 has two strap slots 11;11' corresponding to the strap slots 23 of the side wings 2, and two pin holes 12 adapted for receiving the dowel pins 24 of the side wings 2.

Figure 3:
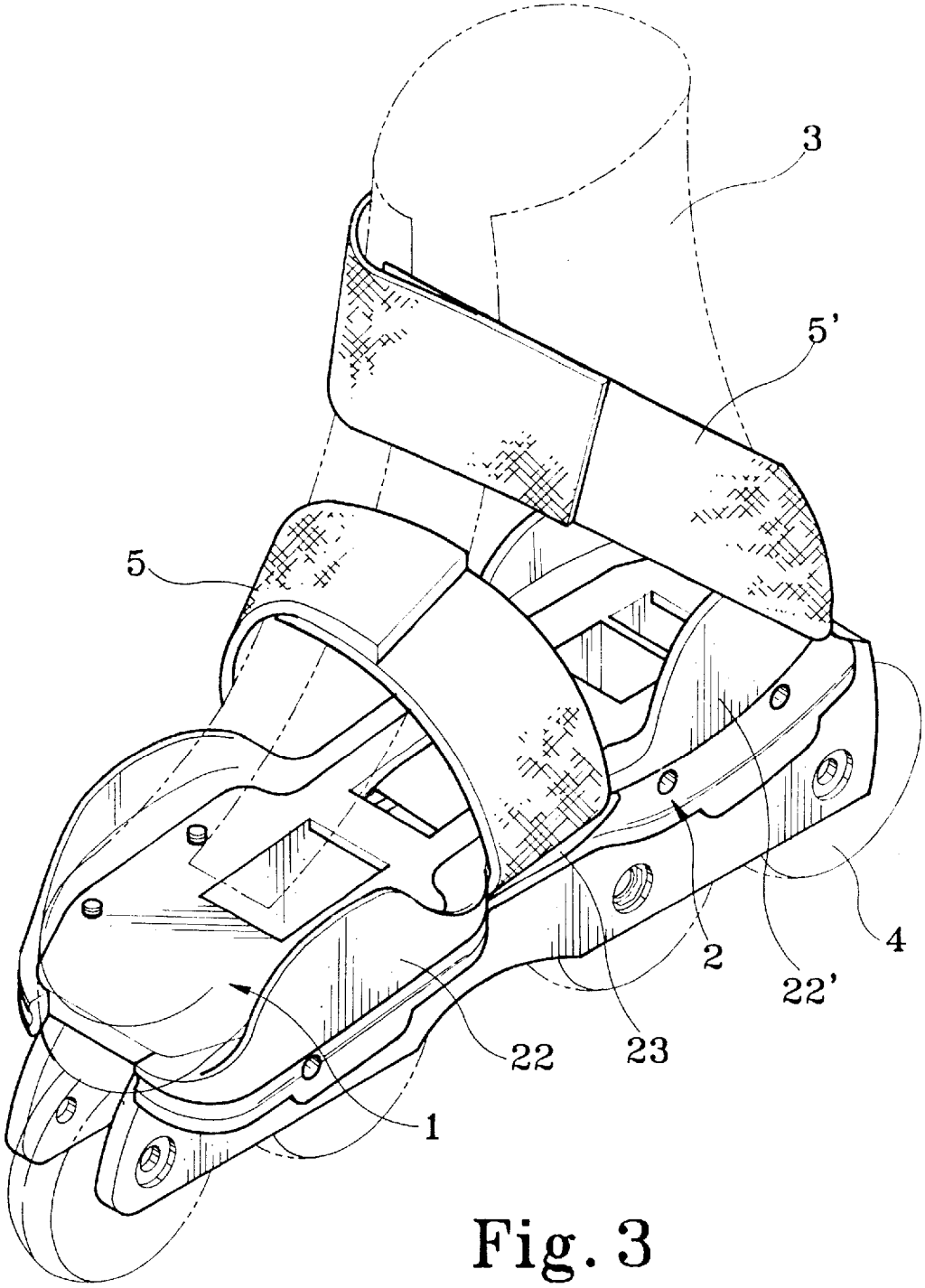
FIG. 3 is a perspective view of the present invention, showing the binding straps installed.

Referring to FIG. 3, a first binding strap 5 is mounted in the strap slots 23 of the side wings 2 and the strap slots 11;11' of the sole plate 1 and fastened to the vamp area of the boot 3, and a second binding strap 5' is mounted on the sole plate 1 and the side wings 2 at the rear side and fastened to the cuff area of the boot 3.

Figure 4A:
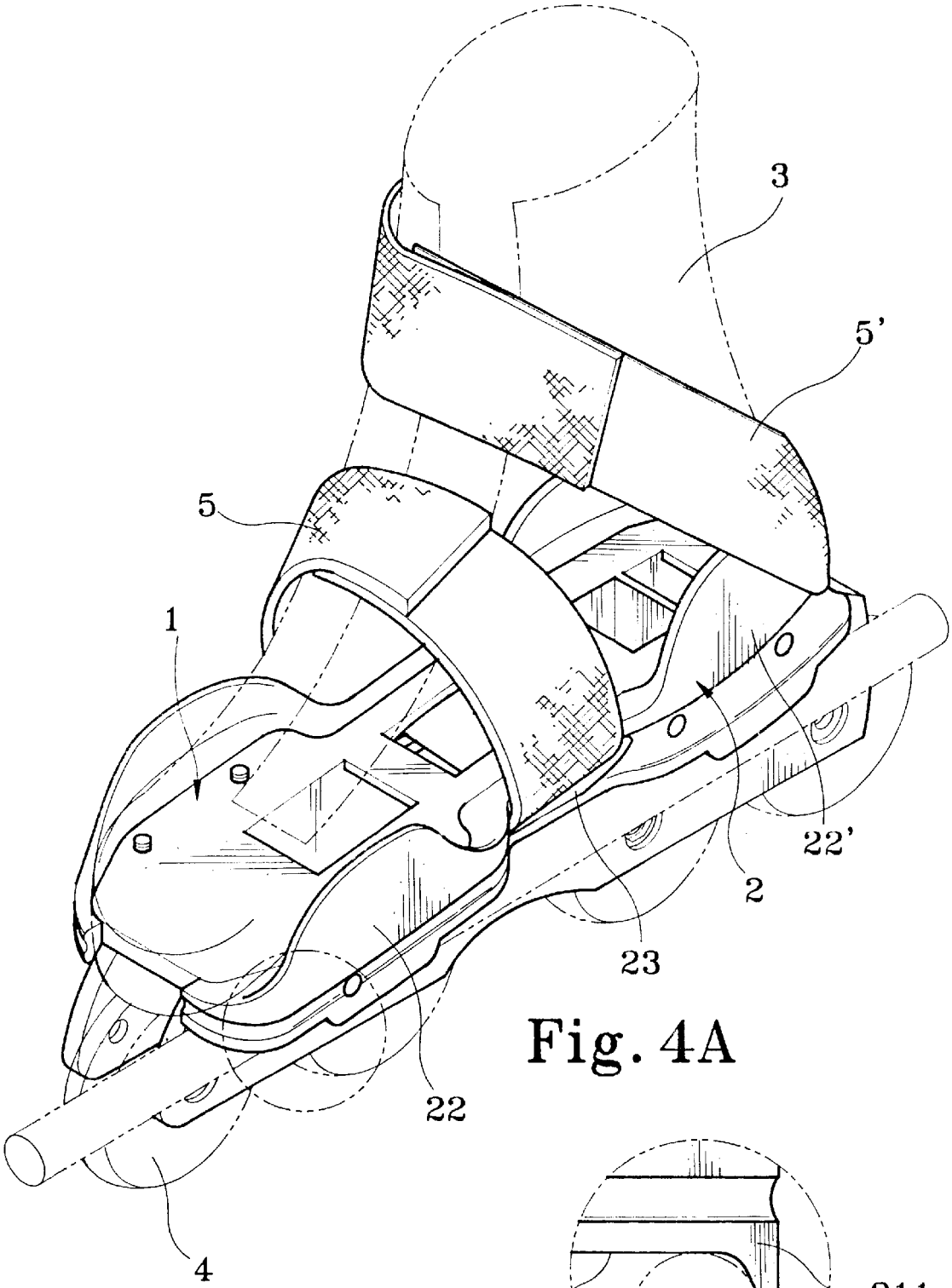
FIG. 4A is an applied view of the present invention, showing the flat base of one side wing moved on a round rod.
Figure 4B:
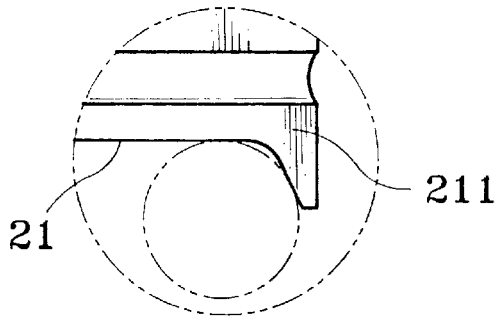
FIG. 4B is an enlarged view of a part of FIG. 4A, showing the flat base and the front guide flange supported on the round rod.

Referring to FIGS. 4 and 4B, by means of the guide flanges 211;211' of the flat base 21 of one side wing 2, the roller skate can be moved along a rail, a rod, a wall edge, etc., to play stunt skating.

Because the side wings 2 are detachably fastened to the sole plate 1 by screws, they are replaceable, and the user can decide if not to install the side wings 2.

I claim:

1. A frame structure for an in line roller skate, comprising a sole plate adapted for holding a boot at the top and a row of rollers at the bottom, and two side wings detachably fastened to two opposite lateral sides of said sole plate by screws, each of said side wings comprising a flat base fastened to said sole plate at a bottom side, a front guide flange and a rear guide flange downwardly extending from said flat base at an outer side, a front bumper flange and a rear bumper flange vertically raised from said flat base for surrounding the boot on said sole plate.

2. The frame structure of claim 1 wherein said sole plate and said side wings have strap slots respectively aligned for mounting a binding strap for securing said boot to said sole plate.

* * * * *